US007887317B1

(12) United States Patent
Barrett, Jr.

(10) Patent No.: US 7,887,317 B1
(45) Date of Patent: Feb. 15, 2011

(54) SYSTEM FOR SEPARATING A CAST PRODUCT FROM A MOLD

(76) Inventor: David J. Barrett, Jr., 108 Fox Crossing Rd., Mount Pleasant Mills, PA (US) 17853

( * ) Notice: Subject to any disclaimer, the term of this patent is extended or adjusted under 35 U.S.C. 154(b) by 1039 days.

(21) Appl. No.: 11/608,063

(22) Filed: Dec. 7, 2006

(51) Int. Cl.
*B28B 7/06* (2006.01)
*B28B 13/06* (2006.01)

(52) U.S. Cl. ..... 425/440; 249/66.1; 249/127; 249/137; 425/439

(58) Field of Classification Search ..... 425/439, 425/440, DIG. 44; 249/127, 137, 66.1
See application file for complete search history.

(56) References Cited

U.S. PATENT DOCUMENTS 3,061,500 A * 10/1962 Kreier, Jr. ..... 425/DIG. 44
3,947,209 A * 3/1976 Fox ..... 425/440
4,349,327 A * 9/1982 Balz ..... 425/440
5,783,135 A * 7/1998 Smith et al. ..... 425/440
2007/0096369 A1 * 5/2007 Webb et al. ..... 264/334
2007/0152376 A1 * 7/2007 Verhoff et al. ..... 425/440
2008/0150196 A1 * 6/2008 Van Cauwenbergh ..... 425/440

* cited by examiner

*Primary Examiner*—James Mackey
(74) *Attorney, Agent, or Firm*—Boyle Fredrickson, S.C.

(57) ABSTRACT

A system and method of separating a cast concrete product from a mold is provided. The system includes a rotating drum arrangement, a catch arm attached to rotate with the drum arrangement, and a mold having at least one cavity to form the concrete product. The mold includes a lead end opposite a trail end relative to a sequence of engagement by the rotating drum arrangement. The mold further includes a grab bar inserted through the mold. The rotating catch arm is configured capture the grab bar in a manner so as to cause the mold to wrap around the drum arrangement and separate the concrete product from the mold.

16 Claims, 7 Drawing Sheets

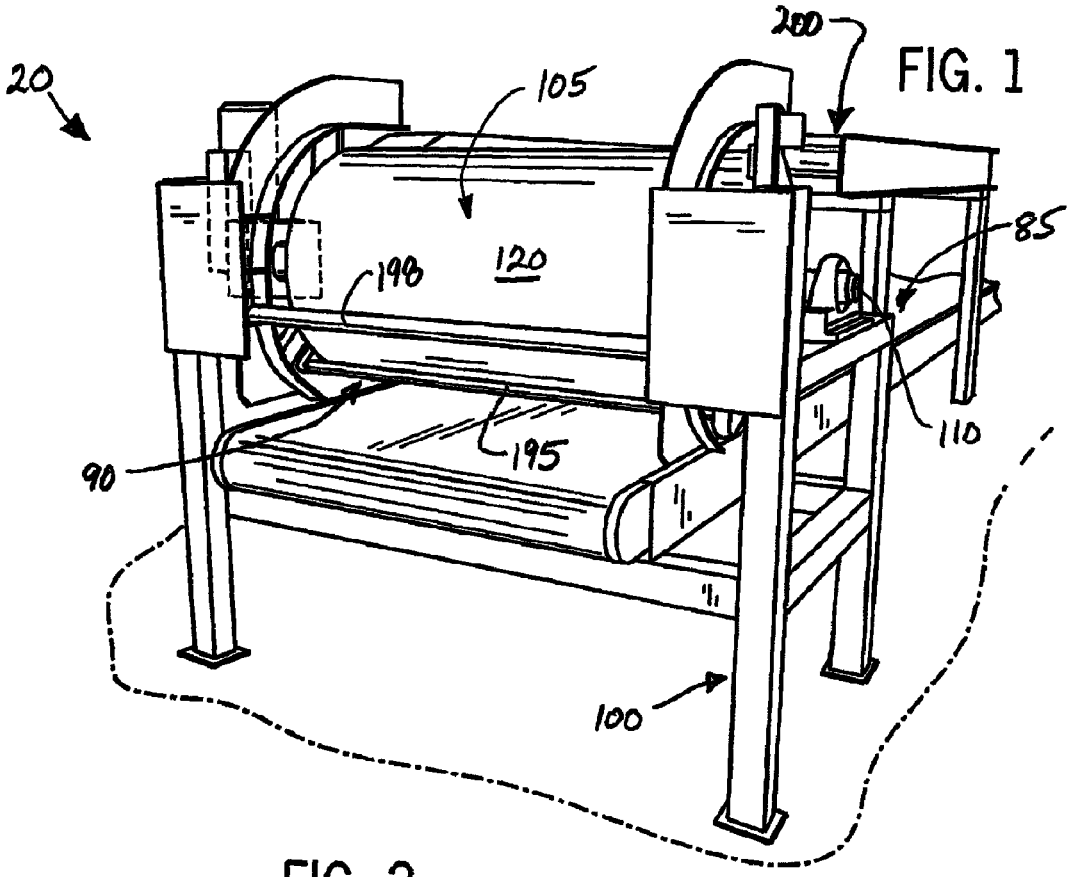
FIG. 1
FIG. 2
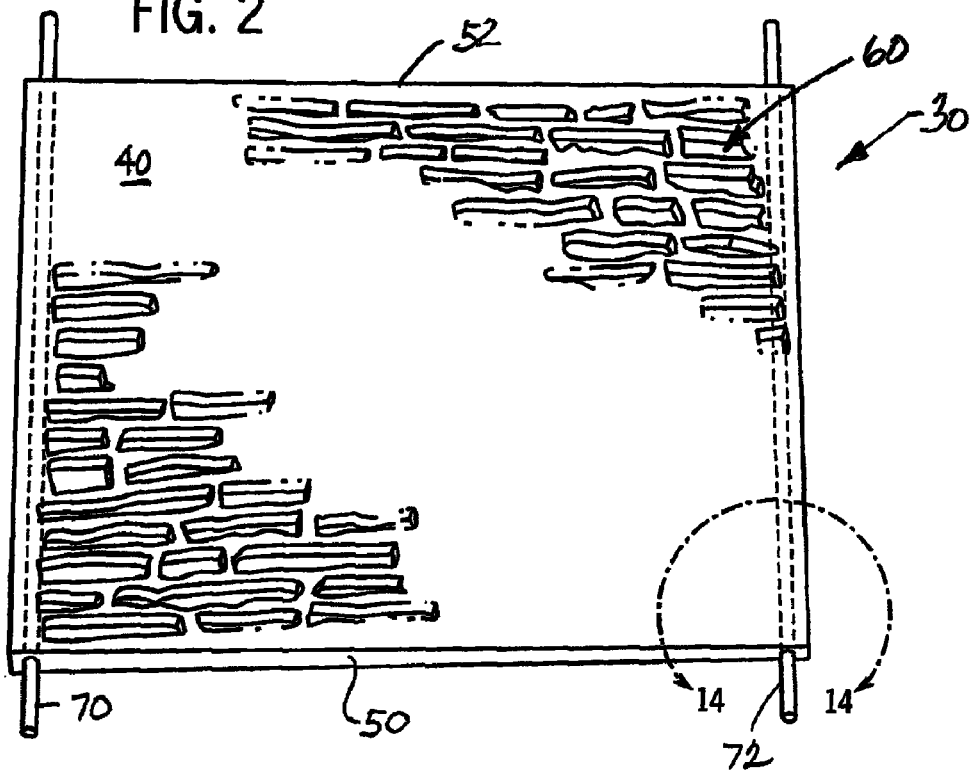

SYSTEM FOR SEPARATING A CAST PRODUCT FROM A MOLD

FIELD OF THE INVENTION

The present invention relates to a system for and method of removing cast concrete products such as veneer stone from a mold, and more particularly to a system that is operable to remove cast concrete products from a mold formed of a flexible material.

BACKGROUND OF THE INVENTION

A stone façade is often desirable in architectural works such as for an exterior entryway, an interior fireplace, or even the entire exterior of a home. However, obtaining stones from a quarry, transporting them to a work site, trimming them to the proper size, and installing them is expensive in terms of both materials and labor. In addition, the weight and bulk of natural stone can require foundation work, the addition of steel lintels, or other extra support structures.

To obtain a stone structure without the related costs and engineering considerations, a simulated stone facing or veneer can be manufactured and installed. Molds simulating stone of various sizes and types are created, and small-aggregate concrete is poured into the molds to create a lighter weight, less expensive alternative to natural stone. Because the veneer stone is relatively lightweight and has a controlled, relatively narrow depth, it can be applied to a building surface much more quickly and easily than is possible with natural stone. Also, the flat inner surface of veneer stone significantly eases installation. In addition, veneer stone has the advantage of being uniform in size, strength, and coloration, while quarried stones naturally vary in these characteristics.

However, the production of realistic-appearing cast stones does pose some manufacturing problems. Specifically, in the past, it has been difficult to separate the cast stones from the mold in an efficient manner. Once the concrete material is placed and allowed to at least partially set in the mold, removal of the cast stones from the mold requires manually intensive labor that is time consuming and expensive.

It is an object of the present invention to provide a system for and method of separating cast concrete products from a mold in a more efficient manner that reduces the need for manually intensive labor during manufacture. Yet another object of the invention is to provide such a system that is relatively simple in its components and in the steps involved in manufacture, yet which is capable of producing cast concrete products that are well-formed.

SUMMARY OF THE INVENTION

The present invention contemplates a system for separating a cast concrete product from a mold. One embodiment of the system includes a rotating drum arrangement, a catch member that rotates with the drum arrangement, and a mold having at least one cavity to form the concrete product. The mold includes a lead end opposite a trailing end relative to a sequence of engagement by the rotating drum arrangement. The mold includes an engagement arrangement, which may be in the form of a grab bar inserted through the mold. Upon rotation of the drum arrangement, the catch member is configured to engage the grab bar in a manner so as to engage the mold against a cylindrical surface of the rotating drum arrangement so as to cause the concrete product to separate from the mold.

One embodiment of the mold includes a mold body formed of a flexible and resilient material. A sleeve extends through the leading end of the mold body, and the grab bar extends through the sleeve. Each end of the sleeve includes a collar configured to prevent the sleeve from sliding relative to the mold. The grab bar is configured to rotate independently of the mold body and the sleeve. The grab bar may be positioned horizontally, and includes opposed ends that each extends beyond a lateral limit of the mold body. The mold may further include a second sleeve and a second grab bar inserted therethrough, which may be configured to be engaged by a second catch arm that rotates with the drum arrangement.

In one form of the system of the invention, the rotating drum arrangement engages the mold as the mold is being advanced by a lower conveyor assembly, and releases the mold to an upper conveyor assembly located above the lower conveyor assembly. The mold is positioned such that an open face of the cavity is directed downward against the lower conveyor assembly. In this manner, the cast concrete product removed from the mold falls from the mold onto the lower conveyor assembly. The system further includes a shroud spaced a distance from the rotating drum arrangement so as to receive the mold therebetween.

The invention also provides a method of separating cast concrete products from a mold that includes steps substantially in accordance with the foregoing summary.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such changes and modifications.

BRIEF DESCRIPTION OF THE DRAWINGS

Preferred exemplary embodiments of the invention are illustrated in the accompanying drawings, in which like reference numerals represent like parts throughout, and in which:

FIG. 1 is a perspective view of a preferred embodiment of the system of the present invention;

FIG. 2 is a perspective view of a mold employed with the system shown in FIG. 1, showing the cavities for creating the cast concrete products;

DETAILED DESCRIPTION OF THE INVENTION

Figure 3:
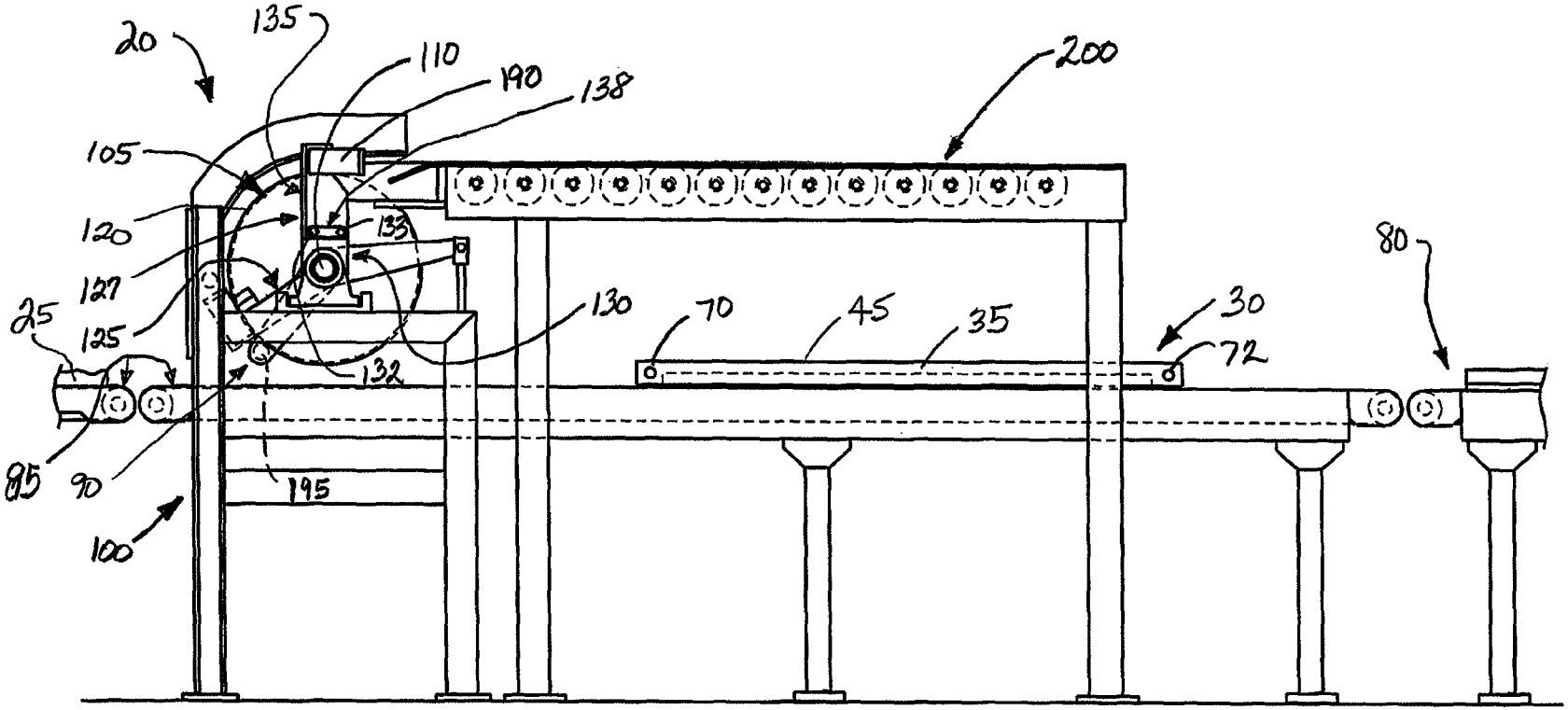
FIG. 3 is a side elevation view of the mold shown in FIG. 2 advancing along the system shown in FIG. 1, in which the cavities of the mold face downwardly to facilitate removal of the cast concrete products from the mold.

FIGS. 1 and 2 illustrate one embodiment of a separation or removal system 20 of the present invention, which is employed to separate or remove one or more cast concrete products 25 from a mold 30. The illustrated concrete product 25 is a cast veneer stone of variable dimensions, although it is understood that the molded or cast concrete product 25 formed in the mold 30 may have any other desired configuration and is not limiting on the invention.

In the illustrated embodiment, the mold 30 is generally adapted to form various sizes of cast concrete products 25. One form of the mold 30 generally includes a horizontally or laterally extending mold body 35 having an upwardly facing surface 40, a bottom surface 45, and a pair of vertically oriented side surfaces 50 and 52 extending therebetween. The mold body 60 is generally formed of a flexible and resilient material capable of being flexed and deformed, and returning to its original linear shape. Representatively, the mold body 60 may be formed of a material such as urethane, although it is understood that any other satisfactory material may be employed.

A series of cavities 60 are formed in the mold body 35. Each cavity 60 extends downwardly from an open face aligned flush with the upwardly facing surface 40. The remaining portions of the cavities 60 are enclosed by the mold body 35. In the illustrated embodiment, the cavities 60 are formed irregular shapes and with textured surfaces, to provide the desired natural shape and textured appearance of stone on the outer surfaces of the cast concrete product 25 formed in the cavity 60. The configuration of the cavities 60 can vary for the desired size, shape, and texture according to the desired final characteristics of the cast concrete product 25.

The mold 30 also includes elongated leading and trailing sleeves or tubes 65 and 67 that are located and formed in the mold body 60. The sleeves 65 and 67 are generally horizontal, and extend from side surface 50 to side surface 52 of the mold body 35. Representatively, the sleeves 65 and 67 may be in the form of tubular members formed of a thermoplastic material such as of polyvinyl chloride (PVC), but the type of composition (e.g., plastic, aluminum or other metal, etc.) of the sleeves 65 and 67 can vary. The sleeves 65 and 67 are preferably cast into the mold body 60 when the mold body 60 is formed. It is understood, however, that the sleeves 65 and 67 may also be secured to or engaged with the mold body 60 in any other satisfactory manner.

The leading sleeve 65 is located at the leading end of the mold 30 relative to the direction of travel through the system 20, while the trailing sleeve 67 is located at the opposite or trailing end of mold 30. Mold body 60 may be reversed, so that the leading sleeve 65 may be located at the trailing end of mold 30 and the trailing sleeve 67 may be located at the leading end of the mold 30.

Grab bars 70 and 72 extend through the sleeves 65 and 67 of the mold 30. In one embodiment, the grab bars 70 and 72 are in the form of elongated rods of a length such that the ends of each of the grab bars 70 and 72 extend laterally beyond the ends of the respective sleeves 65 and 67, and outwardly of the side surfaces 50 and 52 of the mold 30. The grab bars 70 and 72 may be formed of any satisfactory material, such as metal, but other types of material (e.g., plastic, etc.) can be employed.

Collars 75 and 77 are operable to restrain the position of each of the grab bars 70 and 72 relative to the respective sleeves 65 and 67. Each collar 75 and 77 is of a diameter to receive the grab bars 70 and 72 therethrough, and to engage against each end of the respective sleeves 65 and 67. Set screws 74 extend through each of the collars 75 and 77 in a radially inward direction against the grab bars 70 and 72, so as to resist lateral movement of the grab bars 70 and 72 relative to the sleeves 65 and 67, respectively. While the axial position of the grab bars 70 and 72 is fixed relative to sleeves 65 and 67, respectively, each grab bar 65 and 67 is configured to rotate independently about its longitudinal central axis in relation to the respective sleeve 65, 67.

The concrete products are formed in the mold cavities 60 in a conventional manner, by placing concrete material into the upwardly facing mold cavities 60. The concrete material is then allowed to at least partially cure, and the mold 30 is then supplied to a mold inverting assembly 80 that is located to feed the mold 30 and formed concrete products 25 in a proper orientation to a lower conveyor assembly 85. The mold 30 is initially received and secured or clamped at the mold inverting assembly 80 in an upwardly facing orientation so that the open faces of the cavities 60 formed in the mold 30 are directed upward in the vertical direction. Once the mold 30 is secured, the mold inverting assembly 80 is operable to then flip or rotate the mold 30 one hundred-eighty degrees in orientation, such that the open faces of the cavities 60 in the mold 30 are redirected downwardly in the vertical direction. The mold inverting assembly 80 then transfers the re-oriented mold 30 to the lower conveyor assembly 85, and the mold inverting assembly 80 is redirected one hundred-eighty degrees to its original position in preparation for a subsequent operation.

With the mold 30 oriented in the downwardly facing orientation, the lower conveyor assembly 85 transports the mold 30 and cast concrete product 25 from the mold inverting assembly 80 to a demolding arrangement, in the form of a drum assembly 90, for separation of the cast concrete products 25 from the mold 30. Once the cast concrete products 25 are separated from the mold 30, the lower conveyor assembly 85 carries the separated cast concrete products 25 away from the demolding drum assembly 90 for storage and/or shipping of the cast concrete products 25 to a site for installation in the field. The illustrated lower conveyor assembly 85 may be in the form of two aligned conveyor sections, although it should be understood that the number of aligned conveyors or conveyor sections making up the lower conveyor assembly 85 can vary.

The demolding drum assembly 90 is generally configured to flex and deform the mold 30 in a manner so as to cause the cast concrete products 25 to separate and drop from the mold 30 to the lower conveyor assembly 85. In the illustrated embodiment, the demolding assembly 90 includes a frame 100 that supports a rotating drum 105, which is mounted on a shaft 110 that is rotatably driven by a motor drive (shown in phantom lines at 115). The illustrated drum 105 may have a cylindrical shape, and defines a cylindrical surface 120. The drum 105 is arranged to rotate about a horizontally oriented axis of rotation axis defined by the longitudinal axis of shaft 110.

A pair of catch members, in the form of catch arms 125 and 127, are provided at each end of the demolding drum assembly 90 to restrain the mold 30 against the cylindrical surface 120 of the rotating drum 105. The catch arms 125 and 127 are mounted at the shaft 110 to rotate with rotation of the drum 105. Each catch arm 125 and 127 generally extends in a radial outward direction from the rotating shaft 105. Each set of catch arms 125 and each set of catch arms 127 are arranged at the same angular position relative to the axis of rotation defined by shaft 110.

The ends of catch arms 125, 127 are arranged so as to engage the respective grab bars 70 and 72 extending from the sides of the mold 30. Each lead catch arm 125 is located to capture the leading grab bar 70 located at the leading end of the mold 30, while each trailing catch arm 125 is located to capture the trailing grab bar 72 located at the trailing end of the mold 30. In the illustrated embodiment, the leading catch arm 125 is located at a rotational angle of less than one-hundred-eighty degrees in a counterclockwise direction relative to the respective trailing catch arm 127. However, the angular position of the leading and trailing catch arms 125 and 127 in relation to one another can vary to accommodate varying distances between the leading and trailing grab bars 70 and 72 extending from the mold 30.

Figure 5:
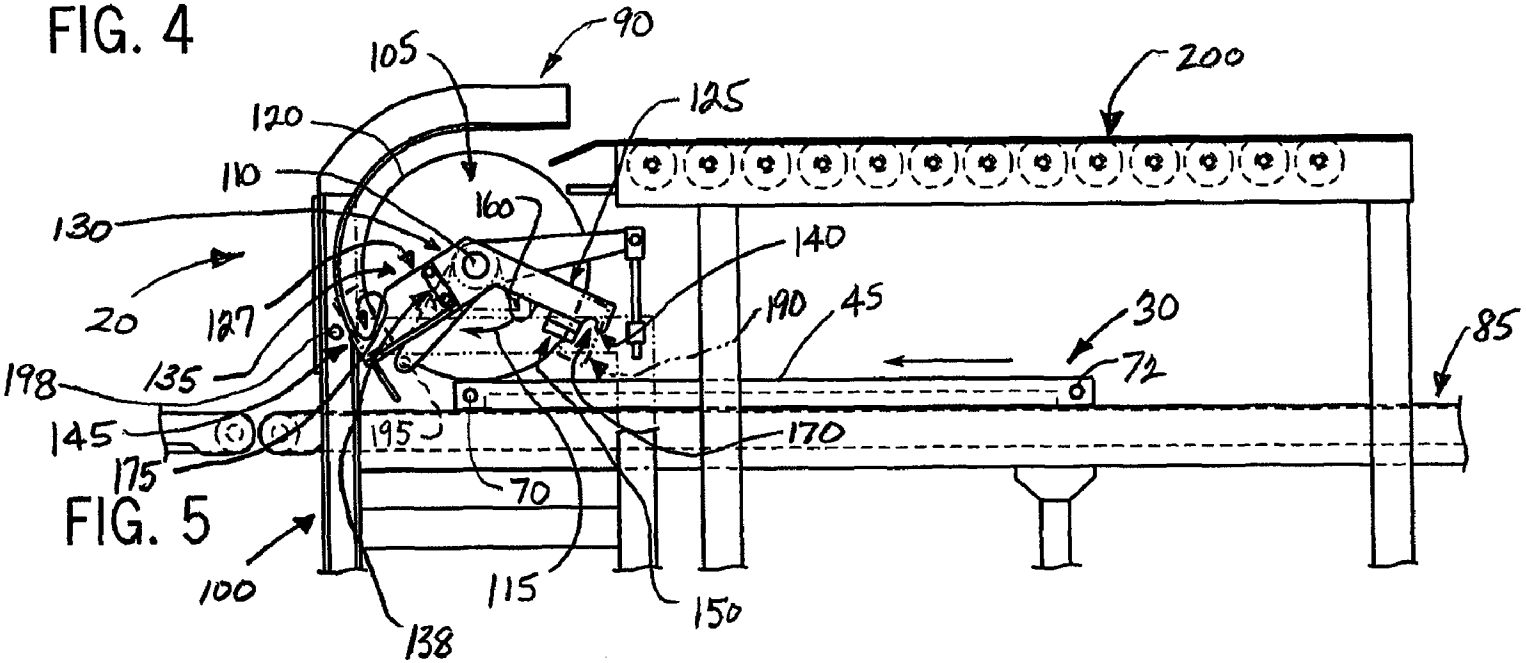
FIG. 5 is a side elevation view of the system shown in FIG. 1, in which a second step of a preferred method of separating the cast concrete products from the mold is illustrated.
Figure 6:
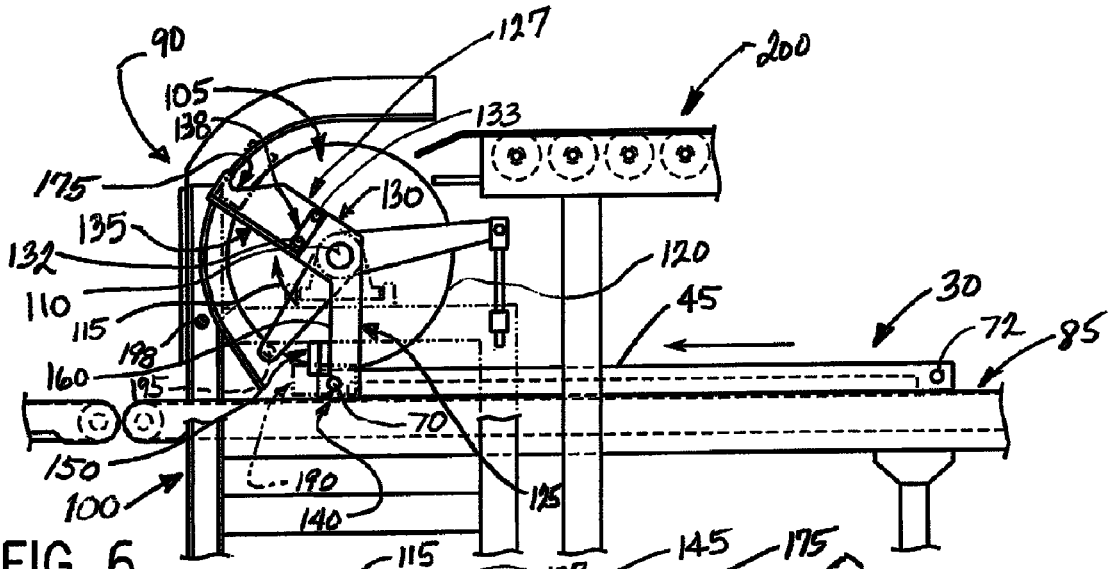
FIG. 6 is side elevation view of the system shown in FIG. 1, in which a third step of a preferred method of separating the cast concrete products from the mold is illustrated.
Figure 7:
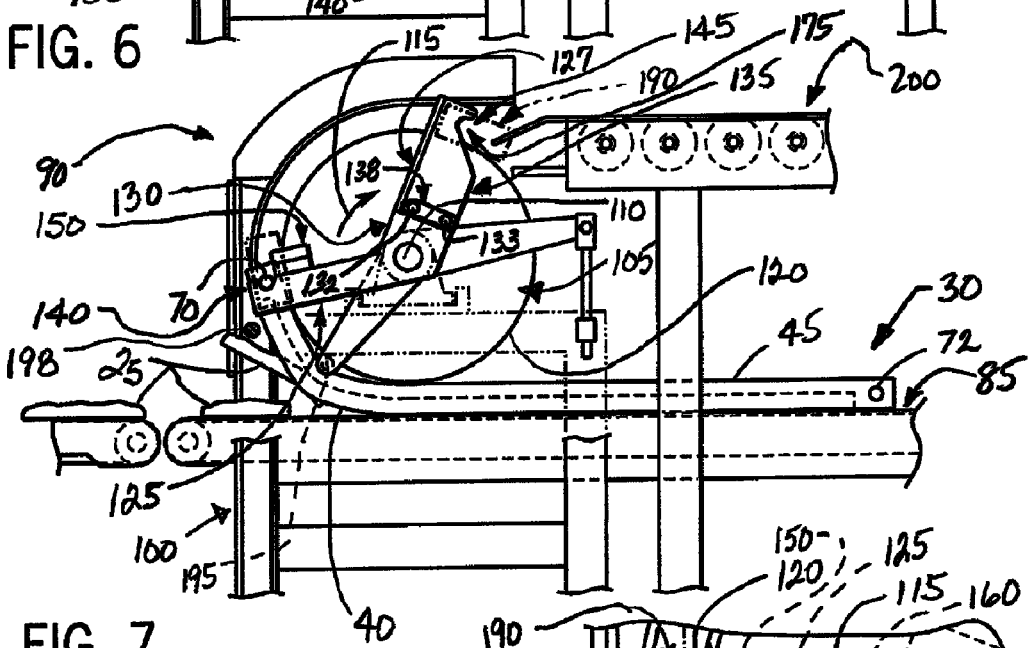
FIG. 7 is a side elevation view of the system shown in FIG. 1, in which a fourth step of a preferred method of separating the cast concrete products from the mold is illustrated.

As shown in FIGS. 5-7, an inner portion 130 of the trailing catch arm 127 is integrally connected to the leading catch arm 125. The radially outward free end of the inner portion 130 of the trailing catch arm 127 includes a pair of threaded fasteners 132 and 133 extending therefrom in a laterally outward direction relative to the drum 105. The fasteners 132 and 133 are configured to attach the remaining radially outward portion 135 of the trailing catch arm 127 to the inner portion 130 of the trailing catch arm 127. An inner radial end of the remaining portion 135 of the trailing catch arm 127 includes a single, elongated slot 138 configured to receive both fasteners 132 and 133 therethrough in a manner that allows adjustment of the position of the trailing catch arm 127 relative to the leading catch arm 125 so as to provide selective adjustment according to the distance between the leading and trailing grab bars 70 and 72 formed in the mold 30.

Still referring to FIGS. 5-7, the outer radial ends of the catch arms 125 and 127 include catch mechanisms 140 and 145, respectively, configured to engage and capture the respective leading and trailing grab bars 70 and 72. The leading catch mechanism 140 at the radial outward free end of the leading catch arm 125 includes a block-shaped member 150 which extends from and is attached by fasteners at a leading edge 160 of the leading catch arm 125 relative to a direction of rotation of the drum 105. A slot 170 is formed at the leading edge 160 of the catch arm 125 radially outward from the block-shaped member 150 so as to receive and seat the leading grab bar 125 of the mold 105. Although the slot 170 is shown and described as being formed at the leading catch arm 125, alternatively the block-shaped structure 150 can be extended to include the slot 170.

The trailing catch mechanism 145 at the trailing catch arm 127 includes a slot 175 integrally formed at a leading edge 177 of the radially outward portion 135 of the trailing catch arm 127 so as to receive and seat the trailing grab bar 72 of the mold 105. The slot 175 is generally asymmetric-shaped, with a linear-aligned, radially inward face 180 having a length that is longer relative to a radially outward face 185 that defines the slot 175. This asymmetric shape enhances capture and grip of the trailing grab bar 72 at a first position (See FIG. 6), and later release of the trailing grab bar 72 at a second position that is elevated relative to the first position (See FIG. 9). Although the illustrated embodiments of the catch mechanisms 140 and 145 at the respective leading and trailing catch arms 125 and 127 differ, it should be understood that the embodiments of the catch mechanisms 140 and 145 can be of similar construction and/or be interchanged, and is not limiting on the invention.

A guide plate 190 is fixedly attached at the free end of each catch arm 125 and 127 at a laterally outward position relative to the catch mechanisms 140 and 145, respectively. The guide plate 190 is located in general horizontal alignment relative to each slot 170 and 175 so as to enhance direction of the grab bars 70 and 72 to be captured in the slots 170 and 175 of the leading and trailing catch arms 125 and 127, respectively.

Figure 13:
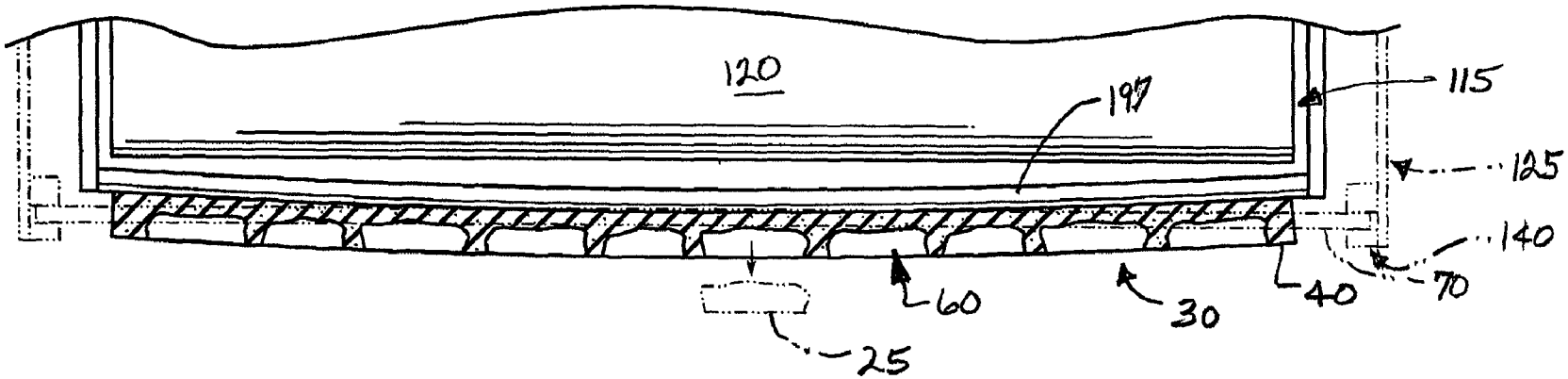
FIG. 13 is an exploded section view of another embodiment of the system of the present invention, in which the elongated removal bar is shown as having a curved configuration.
Figure 14:
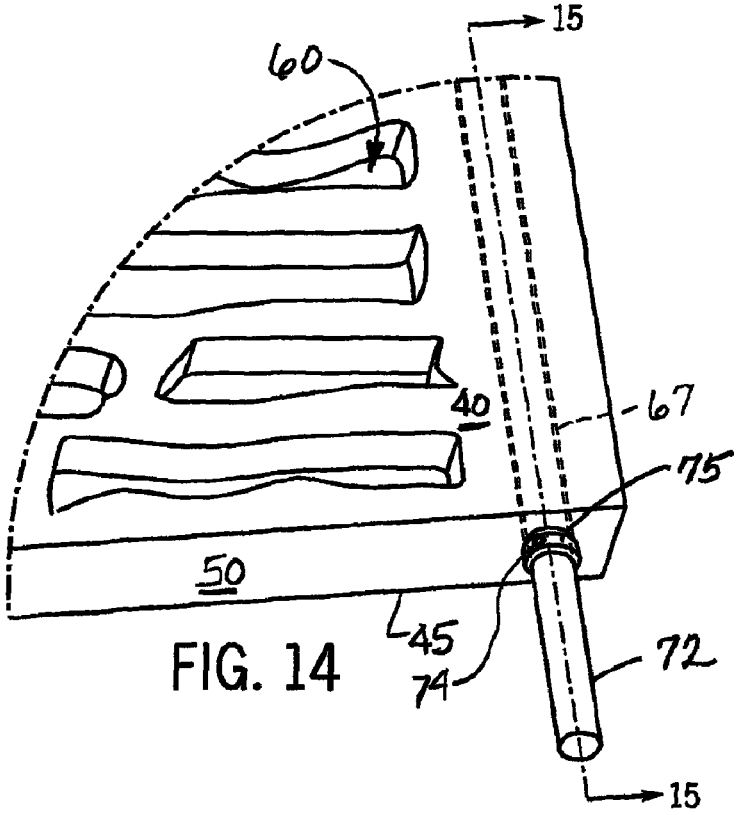
FIG. 14 is an exploded perspective view along line 14-14 in FIG. 2.
Figure 15:
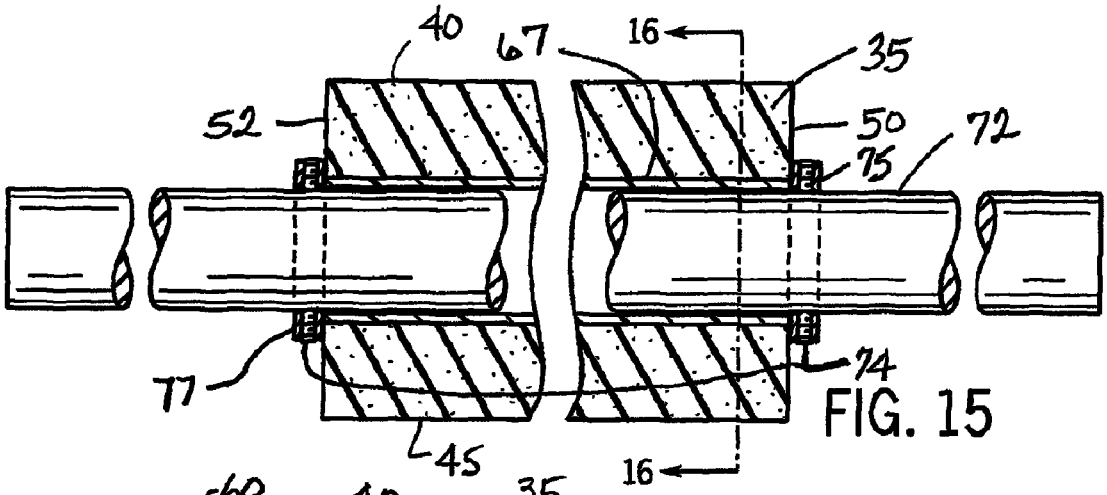
FIG. 15 is an exploded section view along line 15-15 in FIG. 14.
Figure 16:
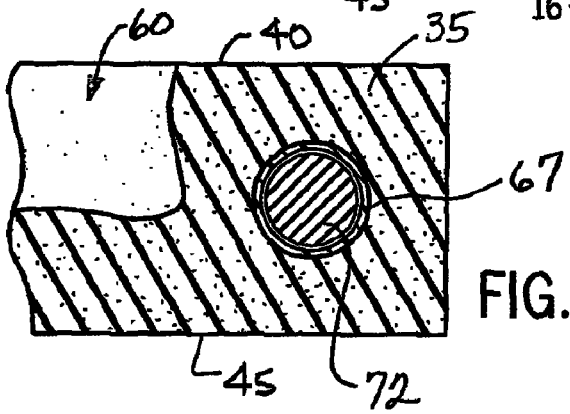
FIG. 16 is an exploded section view along line 16-16 in FIG. 15.

Referring now to FIGS. 5-10 and 12, the demolding drum assembly 90 further includes a push bar 195 configured to enhance separation of the cast concrete products 25 from the mold 30. In the illustrated embodiment, the push bar 195 is in the form of a linear, elongated, cylindrical rod member that extends across a width of and is stationary in relation to the rotating drum 30. The push bar 195 is fixedly attached at a radially outward position from the cylindrical surface 120 of the drum 105 so as to be located between the captured mold 30 and the cylindrical surface 120 of the drum 105. The push bar 195 provides adjustment of the radial outward pressure applied at the bottom surface 45 of the mold 30 so as to enhance separation of the cast concrete products 25 therefrom. Although the illustrated push bar 195 is described as fixed, the push bar 195 can alternatively be mounted to rotate about its central axis independent of the drum 105. FIG. 13 shows an alternative embodiment of the push bar 197. In this embodiment, the push bar 197 is outwardly arcuate or curved between its ends, which is formed so as to have an outwardly arcuate or curved between its ends, so as apply greater radial outward pressure at the center of the mold 30 relative to pressure applied by push bar 197 laterally outward from the center of push bar 197.

The demolding assembly 90 also includes a knock down bar 198 configured to enhance separation of the cast concrete products 25 from the cavities 60 of the mold 30. The illustrated knock down bar 198 is located above and radially outward relative to the push bar 195 so as to receive the mold 30 between the knock down bar 198 and the drum 105. The knock down bar 198 is in the form of an elongated rod member that extends the width of the mold 30 and is coupled to the frame 100. The knock down bar 198 can be fixedly attached or attached to rotate independent of the drum 105.

In use and operation, the cavities 60 of the mold 30 that come into contact with the concrete material are pre-treated with a release agent prior to use so as to facilitate removal of the cast concrete product 25 from the mold 30. Concrete material is provided in a fluidic form and is placed into the mold cavities 60, vibrated, and is then allowed to set or solidify, and at least partially cure in a conventional manner. Excess concrete material is removed such that the concrete material at the open face of the cavities 60 in the mold 30 is aligned generally flush with the upper surface 40 of the mold 30. Also, the mold 30 can be passed through one or more spray stations to provide a mist of water and/or curing compound to enhance the cure process of the concrete material.

Figure 4:
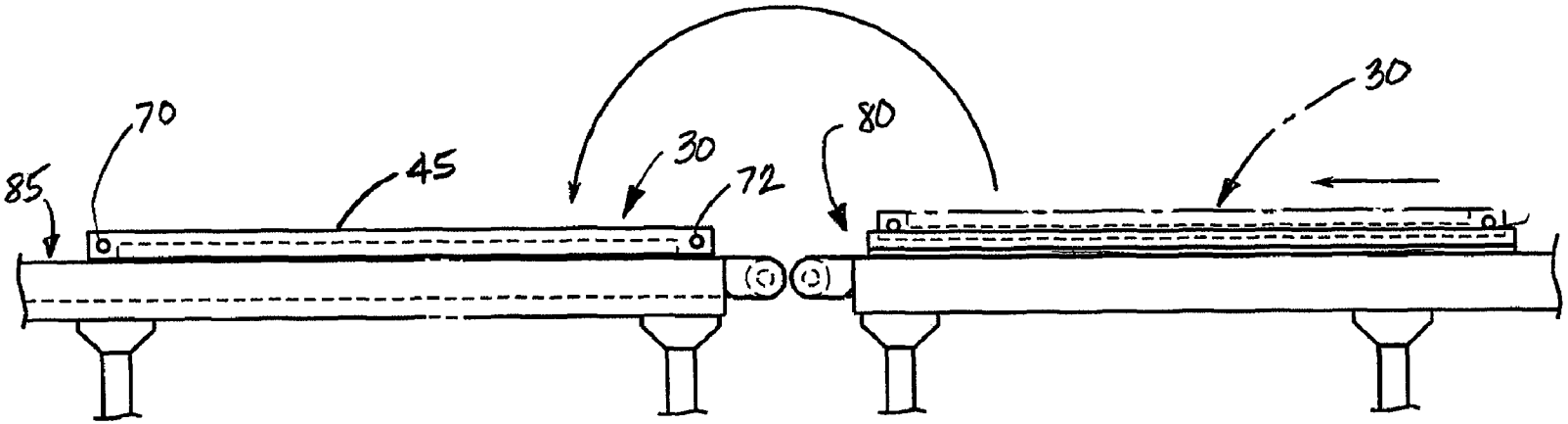
FIG. 4 is a side elevation view of the system shown in FIG. 1, in which a first step of a preferred method of separating the cast concrete products from the mold is illustrated.

Once the concrete material has at least partially cured, the cast concrete products 25 are ready for removal from the mold 30. Referring to FIG. 4, the mold 30 is supplied of a mold inverting assembly 80, where the mold 30 is flipped one hundred-eighty degrees to a downward orientation such that the open faces of the cavities 60 in the mold 30 face downwardly in a vertical direction. The mold 30 is then transferred to the lower conveyor system 85 for transport of the downwardly facing mold 30 to the demolding drum assembly 90.

Figure 8:
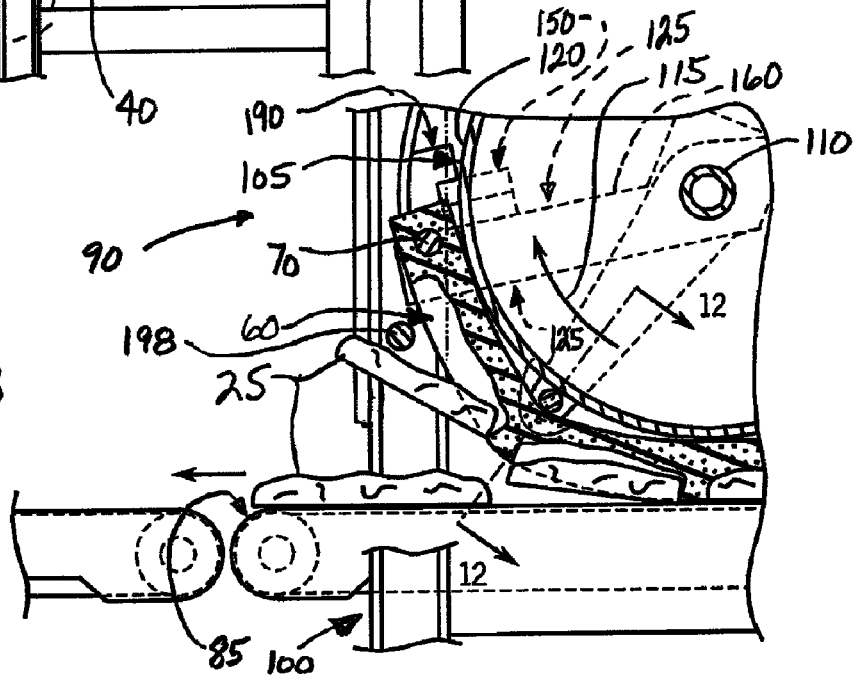
FIG. 8 is a side elevation view of the system shown in FIG. 1, in which a fifth step of a preferred method of separating the cast concrete products from the mold is illustrated.
Figure 9:
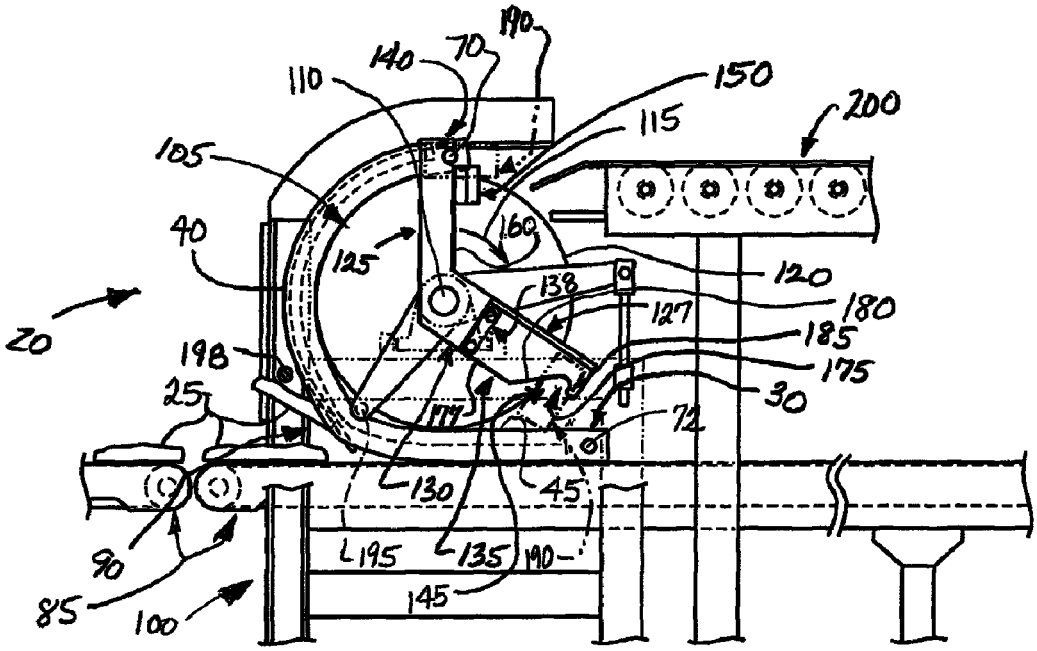
FIG. 9 is a side elevation view of the system shown in FIG. 1, in which a sixth step of a preferred method of separating the cast concrete products from the mold is illustrated.

As shown in FIG. 5, the lower conveyor assembly 85 initially feeds the leading end of the mold 30 to the demolding drum assembly 90. Referring now to FIG. 6, as the drum 105 rotates, the catch mechanism 140 at the end of each leading catch arm 125 captures the aligned end of the leading grab bar 70 that extends outwardly from one of the sides of mold 30. As shown in FIGS. 7 and 8, the catch mechanism 140 at the leading catch arm 125 restrains the end of the captured leading grab bar 70 and mold 30 against the circumferential surface 120 of the rotating drum 105. The combination of the leading catch arm 125 pulling on the leading grab bar 70 and the radially outward forces associated with wrapping the mold 30 around the circumferential surface 120 of the drum 105 causes the cast concrete products 25 to separate from the mold 30 and fall onto the lower conveyor assembly 85. FIGS. 7 and 8 also show the catch arm 125 pulling the mold 30 over the push bar 195. The fixed push bar 195 applies an additional radially outward force, in addition to the radial outward forces applied by the rotating drum 105 to the mold 30, that enhances separation of the cast concrete products 25 from the mold cavities 60. As shown in FIG. 9, the configuration of the leading catch arm 125 in combination with the grab bar 70 and drum 105 causes the mold 30 to be restrained against cylindrical surface 120 of the rotating drum 105 so as to wrap around approximately one hundred-eighty degrees of the circumference of the drum surface 120.

Figure 10:
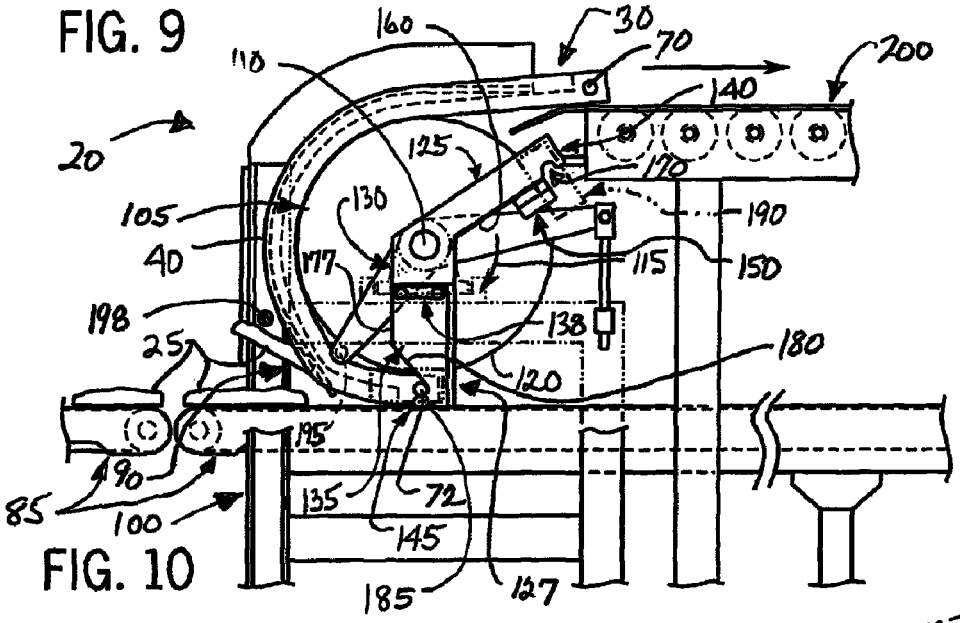
FIG. 10 is a side elevation view of the system shown in FIG. 1, in which a seventh step of a preferred method of separating the cast concrete products from the mold is illustrated.

Referring now to FIG. 10, continued rotation of the drum 105 causes the catch mechanism 145 at the end of each rotating trailing catch arm 127 to capture the aligned end of the trailing grab bar 72 extending outwardly from one of the sides of the mold 30. The catch mechanisms 145 at the trailing catch arms 127 secures the trailing grab bar 72 and mold 30 against the cylindrical surface 120 of the rotating drum 105, in a manner similar to the catch arms 125 and grab bar 70 described above. Continued rotation of the drum 105 moves the mold 30 past the push bar 195. The push bar 195 continues to apply a consistent radially outward force on the mold 30, causing the cast concrete products 25 to separate and drop from the mold 30. The knock down bar 198 is located to engage the partially separated concrete product 25 from the mold 30 so as to drop to the lower conveyor assembly 85. The lower conveyor assembly 85 carries the separated cast concrete products 25 away from the demolding drum assembly 90 for packaging, storage and/or shipment.

As shown in FIG. 10, with continued rotation of the drum 105, the catch mechanism 140 at the leading catch arm 125 releases the leading grab bar 70 of the mold 30. Such release of the leading grab bar 70 allows the leading end of the mold 30 to be received at an elevated conveyor assembly 200 located above the lower conveyor assembly 85. Continued rotation of the drum 105 leads to the release of the trailing grab bar 72 from the catch mechanism 145 at the trailing catch arm 127, allowing the remainder of the mold 30 to be received at the upper conveyor assembly 200.

Figure 11:
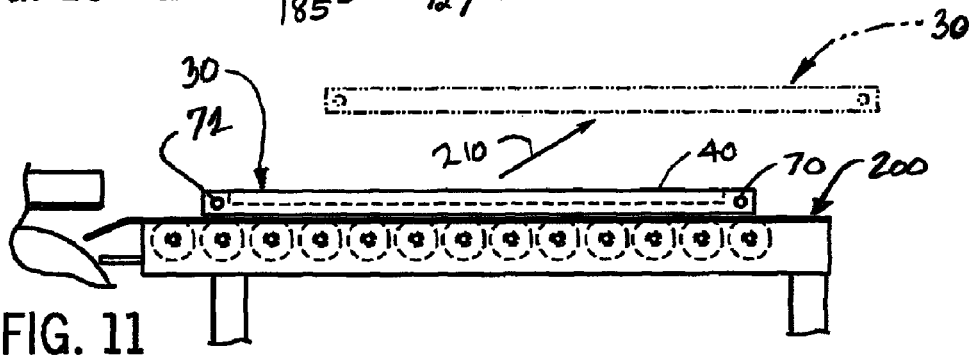
FIG. 11 is a side elevation view of the system shown in FIG. 1, in which an eighth step of a preferred method of separating the cast concrete products from the mold is illustrated.
Figure 12:
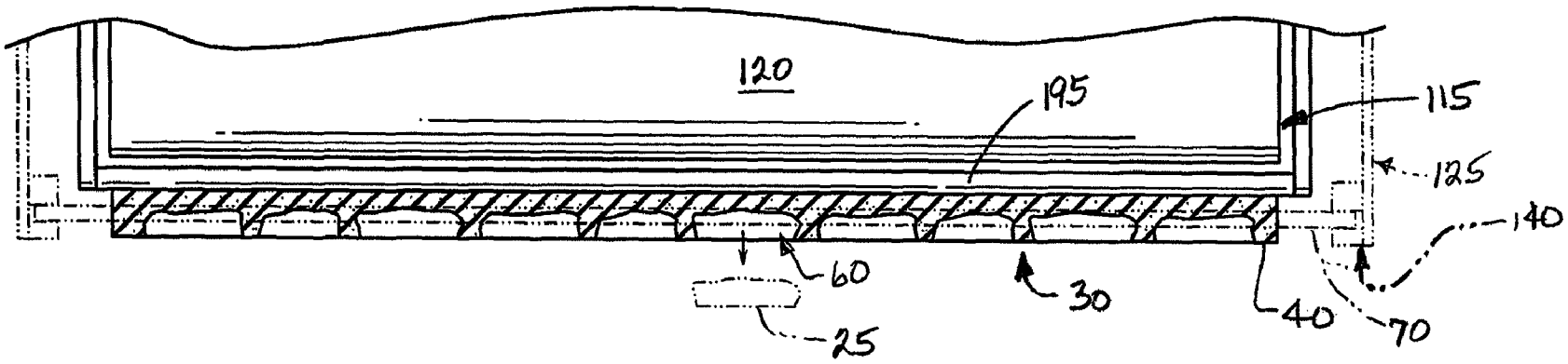
FIG. 12 is an exploded section view along line 12-12 shown in FIG. 8.

As shown in FIG. 11, the demolding drum assembly 90 releases the mold 30 to the upper conveyor assembly 200 in the upright orientation, similar to the original orientation of mold 30 when mold 30 is supplied to the inverting assembly 80 as described above, such that the open faces of the cavities 60 in the mold 30 are directed upwardly in the vertical direction. The upright orientation of the mold 30 allows the mold 30 to be readily transferred (as shown in phantom and by reference 210) from the upper conveyor assembly 200 via a vacuum assembly (not shown), in preparation for a subsequent cycle.

While the invention has been shown and described with respect to a specific embodiment, it is understood that various alternatives and modifications are contemplated as being within the scope of the present invention. For example, and without limitation, the mold 30 can be separated or continuous. In another example, the mold 30 may be formed with any number of cavities 60 having any desired configuration, and is not limited to the specific design as shown and described. Further, it is also understood that the mold 30 may be formed with a single upwardly extending portion to form a single row of stones, or with an upwardly extending portion to form multiple rows of stones, and is not limiting on the invention. Furthermore, the mold 30 may be formed to include any number of sleeves 65 and 67 and respective grab bars 70 and 72.

Various alternatives and embodiments are contemplated as being within the scope of the following claims particularly pointing out and distinctly claiming the subject matter regarded as the invention.

I claim:

1. A mold for forming a cast concrete product, comprising:

a mold body formed of a flexible and resilient material and having at least one cavity to form the concrete product, the mold body having a leading end opposite a trailing end; and an engagement member carried by the mold body, wherein the engagement member extends laterally outwardly relative to the mold body, wherein the engagement member comprises a bar that extends laterally through the mold and defining a pair of ends that extend laterally outwardly relative to side surfaces defined by the mold, and wherein the bar is secured to the mold via a laterally extending sleeve in the mold, wherein the sleeve defines a lateral passage through which the bar extends.

2. The mold of claim 1, wherein the bar is configured to rotate independently of the mold body and the sleeve.

3. A system for demolding a cast concrete product, comprising:

a rotating drum arrangement;

a catch member that rotates with the drum arrangement;

a mold having at least one cavity to form the concrete product, wherein the mold has a leading end and a trailing end and includes an engagement member located toward the leading end, wherein the rotating catch member is configured to engage the engagement member in a manner so as to restrain the mold against a cylindrical surface defined by the rotating drum arrangement so as to cause the concrete product to separate from the mold.

4. The system of claim 3, further comprising a separating member spaced from and fixed in position relative to the rotating drum arrangement, wherein the separating member is disposed between the mold and the surface of the rotating drum arrangement.

5. The system of claim 4, wherein the separating member comprises an axially extending separating bar.

6. The system of claim 5, wherein the separating bar is curvilinear along its length.

7. The system of claim 5, wherein the mold is formed of a flexible and resilient material capable of deforming from a flat configuration to an arcuate configuration between the leading and trailing ends when the mold is engaged with the cylindrical surface of the drum arrangement.

8. The system of claim 3, wherein the engagement member extends generally parallel to a rotational axis of the drum arrangement and includes opposed ends, each of which extends beyond a lateral extent of the mold.

9. The system of claim 3, further comprising a sleeve extending through the leading end of the mold, wherein the sleeve defines a passage through which the engagement member extends.

10. The system of claim 9, wherein the engagement member is configured to rotate within the sleeve passage independently of the mold and the sleeve.

11. The system of claim 9, further comprising a second sleeve and a second engagement member located toward the trailing end of the mold.

12. The system of claim 11, further comprising a second catch member configured to engage the second engagement member upon rotation of the drum arrangement.

13. The system of claim 3, wherein the rotating drum arrangement is positioned such that the rotating drum arrangement moves the mold from a lower conveyor to an upper conveyor located above the lower conveyor, and wherein the cast concrete product separates from the mold and is deposited onto the lower conveyor.

14. The system of claim 13, wherein movement of the mold from the lower conveyor to the upper conveyor is operable to invert the mold from a downwardly facing orientation on the lower conveyor to an upwardly facing orientation on the upper conveyor.

15. The system of claim 3, wherein an open face of the least one cavity is located on the mold opposite the cylindrical surface of the rotating drum arrangement.

16. The system of claim 9, wherein each end of the sleeve includes a collar configured to maintain the axial position of the engagement member within the sleeve passage.

* * * * *